US009470057B2

(12) United States Patent
Herland et al.

(10) Patent No.: US 9,470,057 B2
(45) Date of Patent: Oct. 18, 2016

(54) GATE VALVE ASSEMBLY

(75) Inventors: Jan Herland, Nesbru (NO); Lars Lundheim, Oslo (NO)

(73) Assignee: AKER SUBSEA, Lysaker (NO)

( * ) Notice: Subject to any disclaimer, the term of this patent is extended or adjusted under 35 U.S.C. 154(b) by 173 days.

(21) Appl. No.: 13/976,250

(22) PCT Filed: Dec. 22, 2011

(86) PCT No.: PCT/IB2011/055891

§ 371 (c)(1),
(2), (4) Date: Sep. 30, 2013

(87) PCT Pub. No.: WO2012/093312

PCT Pub. Date: Jul. 12, 2012

(65) Prior Publication Data

US 2014/0014356 A1 Jan. 16, 2014

(30) Foreign Application Priority Data

Jan. 4, 2011 (SE) ..... 1150006

(51) Int. Cl.
*E21B 29/08* (2006.01)
*E21B 33/064* (2006.01)
*E21B 34/04* (2006.01)

(52) U.S. Cl.
CPC ..... *E21B 33/064* (2013.01); *E21B 29/08* (2013.01); *E21B 34/04* (2013.01)

(58) Field of Classification Search
CPC ..... E21B 33/06; E21B 29/04; E21B 29/08; F16K 3/02
USPC ..... 166/368
See application file for complete search history.

(56) References Cited

U.S. PATENT DOCUMENTS 3,590,920 A 7/1971 Orund
3,870,101 A 3/1975 Helmus
(Continued)

FOREIGN PATENT DOCUMENTS

CN 201613377 U 10/2010

OTHER PUBLICATIONS

Examination Report issued on Mar. 3, 2014 in Great Britain patent application No. GB1312529.9, pp. 1-3.
(Continued)

*Primary Examiner* — Matthew R Buck
*Assistant Examiner* — Patrick Lambe
(74) *Attorney, Agent, or Firm* — Jeffrey S. Melcher; Manelli Selter PLLC

(57) ABSTRACT

A gate valve assembly (100) for use in subsea workover systems is disclosed. In an embodiment, the gate valve assembly (100) includes a valve block (102). The valve block (102) includes a cutting gate (204) disposed in a valve cavity (206) such that the cutting gate (204) can engage in a reciprocating motion in the valve cavity (206) between an "open" position and a "closed" position. The reciprocating motion of the cutting gate (204) results in a cutting operation of a tubing conveyed string passing through the gate valve assembly (100). The gate valve assembly (100) further includes a slug pit (202) formed in the valve block (102) alongside the valve cavity (206). The slug pit (202) defines an opening which can contain one or more cuttings from tubing conveyed springs resulting from the cutting operation. The reciprocating motion of the cutting gate (204) transports one or more cuttings of the tubing conveyed string to the slug pit (202).

15 Claims, 5 Drawing Sheets

(56) References Cited

U.S. PATENT DOCUMENTS

| | | | | |
|---|---|---|---|---|
| 3,967,647 | A | 7/1976 | Young | |
| 4,476,935 | A | 10/1984 | Hynes | |
| 4,512,411 | A | 4/1985 | Pringle | |
| 4,612,983 | A | 9/1986 | Karr | |
| 4,671,312 | A * | 6/1987 | Bruton | 137/315.29 |
| 5,370,362 | A | 12/1994 | Kent | |
| 5,501,424 | A | 3/1996 | Williams | |
| 6,454,015 | B1 | 9/2002 | Armstrong | |
| 7,264,060 | B2 | 9/2007 | Wills | |
| 2010/0102263 | A1* | 4/2010 | Liew | E21B 29/04 251/326 |
| 2010/0319906 | A1* | 12/2010 | Van Winkle | E21B 33/063 166/85.4 |

OTHER PUBLICATIONS

International Search Report and Written Opinion issued in PCT/IB2011/055891, on Jun. 3, 2012.

Examination Report issued on Dec. 9, 2015 in Mexican patent application No. 0613.02.MX.018, pp. 1-6.

Examination Report issued on Feb. 16, 2016 in Chinese patent application No. 201180064138.2, pp. 1-38.

Examination Report issued on Feb. 26, 2016 in Australian patent application No. 201135087 pp. 1-3.

* cited by examiner

GATE VALVE ASSEMBLY

TECHNICAL FIELD OF INVENTION

This invention relates to gate valves assemblies for subsea invention package used for isolating or sealing oil wells during emergencies. In particular, the invention relates to a gate valve with a slug pit in the valve block to contain cuttings from a cutting operation of any slick line, wire, cable, pipe, coil tubing or any elongated member extending through the cutting gate hereinafter referred to as tubing conveyed strings during a well shut down process.

BACKGROUND OF INVENTION

In typical oil and gas extraction techniques, tubing conveyed strings are often lowered into wells through a gate valve assembly that forms a part of subsea well control packages (WCP). In the context of subsea oil wells, a subsea WCP is installed to provide means to isolate and seal the well in emergencies. Such gate valve assemblies utilize gate valves to shut off or open a path through the gate valve assembly. Ideally, it is desirable that the tubing conveyed strings are removed from the gate assembly before the gate valve is completely closed. However, during emergencies, the time taken to perform the shutting down or sealing operation should be the minimized and a shearing of the tubing conveyed strings are preferred.

The gate valve assembly typically includes a valve body having a valve chamber therein with an inlet port and an outlet port (along a valve bore), and a linearly moveable gate having a through hole which when aligned with the inlet and outlet ports forms a path. The gate is moved linearly to open and close the flow path by means of actuating mechanisms. During operations which require the shutting down of an oil or gas well, there is a need for a mechanism that is capable of shearing the tubing conveyed strings.

To accomplish this, existing gate valves have been designed to have shearing surfaces on the inner circumferential edges of either the gate or seat flow passage so that when the gate is moved from an "open" position to a "closed" position, the tubing conveyed strings are sheared by the shearing surfaces. In typical cases of "double shear" gate valves, such shearing will cause tubing conveyed strings cutting (or slug pieces) to remain in the through hole of the cutting gate when the gate valve moves from the open position to the closed position. The tubing conveyed strings cuttings may obstruct or jam the gate valve when the gate valve moves back to the "open" position from the "closed" position. The tubing conveyed strings cuttings might fall into the valve bore (well) when the gate valve moves from the closed position to open position. Such a jamming or falling of the pieces into the well is undesirable in certain scenarios.

Existing cutting gate valves designed to address the aforementioned problems have included the use of a recessed cutting edge for wireline cutting operations. Such a recessed cutting edge in a wire cutting gate valve is disclosed in US patent no. 2010/0102263. The recess collect the wireline cutting formed after the cutting operation. However, the recess contain the cutting even after the gate moves from "closed" position to "open" position. In addition, the wireline cutting in the recess may drag against the valve block along the valve cavity, thereby possibly damaging the profile of the valve cavity. Moreover, the wire cutting gate valve disclosed above cuts tiny wireline and may not be suitable for cutting greater dimensions typically used in WCP.

Therefore, there is a need for a gate valve assembly that at least addresses the above mentioned short coming with respect to double shear valve and that may be able to handle tubing conveyed string cuttings in general, i.e. cuttings of greater dimensions than just a wireline.

SUMMARY OF THE INVENTION

A gate valve assembly for use in subsea workover systems is disclosed. In an embodiment, the gate valve assembly includes a valve block. The valve block includes a cutting gate valve placed in a valve cavity such that the cutting gate valve can engage in a reciprocating motion in the valve cavity between an "open" position and a "closed" position. The reciprocating motion of the cutting gate valve results in a cutting operation of a tubing conveyed string passing through the gate valve assembly. The gate valve assembly further includes a slug pit formed in the valve block alongside the valve cavity. The slug pit represents an opening which will contain cuttings from the tubing conveyed strings resulting from the cutting operation. The reciprocating motion of the cutting gate valve transports one or more cuttings of the tubing conveyed strings to the slug pit. The reopening of the valve will not be obstructed by any cuttings that are left in the slug pit.

These and other advantages and features of the present invention will become more apparent from the following descriptions and appended claims, or may be learned by the use of the invention as set forth hereinafter.

BRIEF DESCRIPTION OF DRAWINGS

To further clarify the above and other advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings in which.

DETAILED DESCRIPTION OF THE INVENTION

Figure 1:
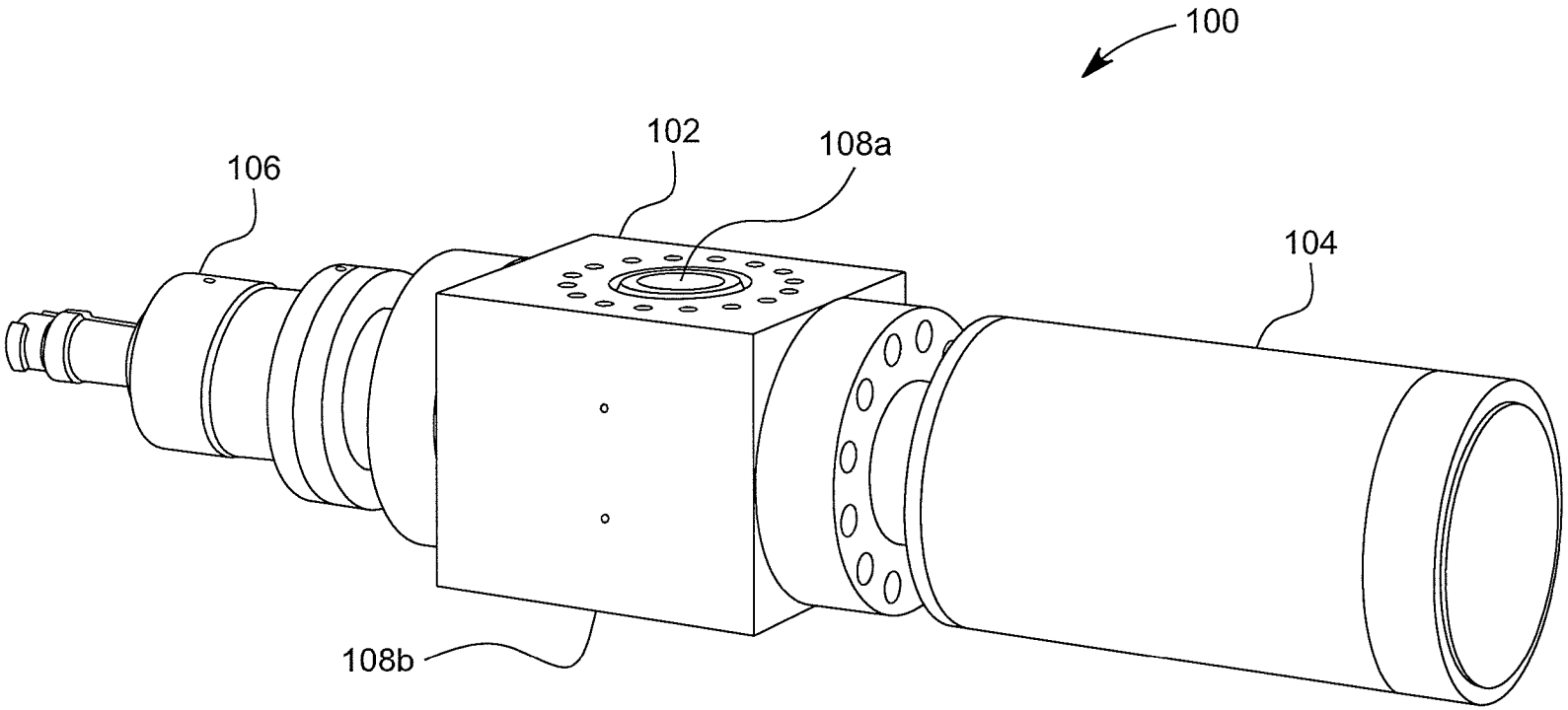
FIG. 1 illustrates a subsea gate valve assembly according to a preferred embodiment of the invention.

Referring now to the figures, and more particularly to FIG. 1, there is shown a perspective view of a subsea gate valve assembly 100, in accord with a preferred embodiment of the present invention. The subsea gate valve assembly 100 includes a valve block 102 that houses one or more components of the gate valve assembly. The valve block 102 has an inlet and an outlet port 108 *a*, 108 *b* that allows tubing conveyed strings to pass through the valve block 102. In an embodiment, the tubing conveyed strings can correspond to one or more of a wire, a cable, a coiled tubing, a pipeline, a slickline, etc. having dimensions that lies within a wide range, e.g. 3-75 mm. The outer diameter of the tubing may normally be in the range 100-250 mm. It may be appreciated that in typical subsea oil well deployment techniques, the gate valve assembly 100 forms a part of an Emergency Disconnect Package (EDP) and a Well Control Package (WCP) in subsea workover systems. The gate valve assembly 100 offers a control mechanism to manipulate the passage through the valve. It may also be appreciated that the subsea gate valve assembly 100 discussed herein is of a type that may be utilized in deep water.

In certain cases of emergencies, the passage would need to be suspended or shut down temporarily or permanently. Such emergencies may include, but are not limited to, a fire, an oil spill, well maintenance, etc. The gate valve assembly 100 includes a gate valve that can be operated by the actuating mechanisms (e.g. 104 and 106) to close or open the path through the gate valve. As shown in the figure, the gate valve assembly 100 includes two actuators conjoined to the valve block 102 on opposite sides. In many cases, it may be desirable to include both a hydraulic actuator 106 and a failsafe actuator 104 for ensuring that the passage through the valve block 102 is properly controlled in an operation that include both cutting and closing. In a preferred embodiment, such actuators 104, 106 can correspond to a spring actuator 104 and a hydraulic actuator 106 mechanically joined to the valve block 102 to work in tandem for the aforementioned purpose. The mechanical coupling is achieved by means of a shaft 107 connected to the hydraulic actuator 106, and by means of a push rod 109 connected to the spring actuator. The shaft 107 may be guided and sealed by means of a first guiding body 101 and the push rod 109 may be guided and sealed by means of a second guiding body 103. The two actuators may optionally also be positioned on one side of the valve block 102. The hydraulic actuator may work together with the fail safe actuator in any emergency operation when the cutting function is needed, since the fail safe actuator normally may not always have enough force to cut through the tubing conveyed strings without extra force from the hydraulic actuator. If for any reasons, the normal hydraulic power fails, then a pre-loaded hydraulic package (not shown) may be provided to give the necessary force to open and close the gate valve. The valve block 102 has an inlet port 108*a* and an outlet port 108*b* through which the tubing conveyed strings can pass.

Figure 2:
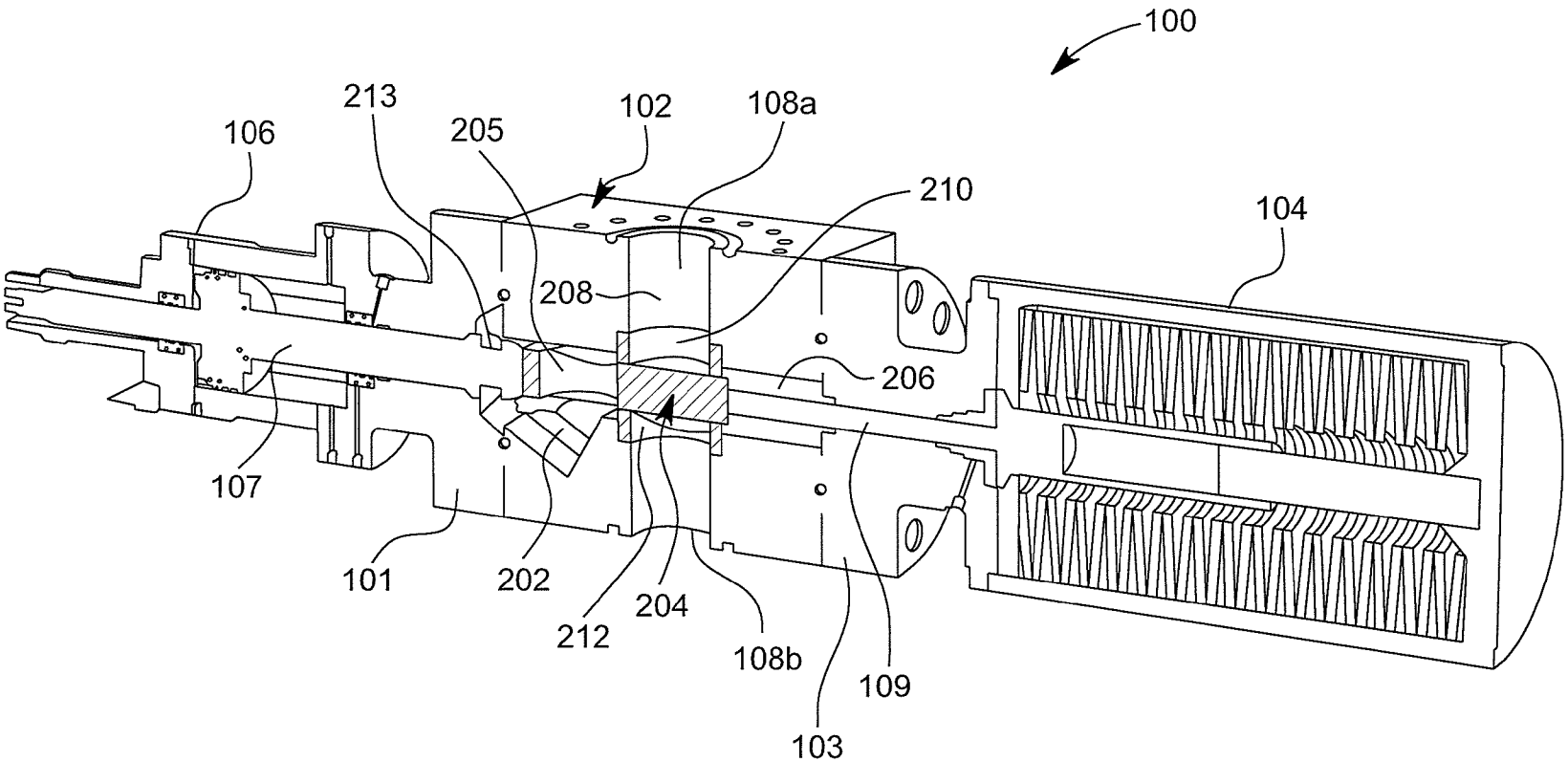
FIG. 2 illustrates a schematic, sectioned perspective view of the preferred gate valve assembly in an activated mode.
Figure 3:
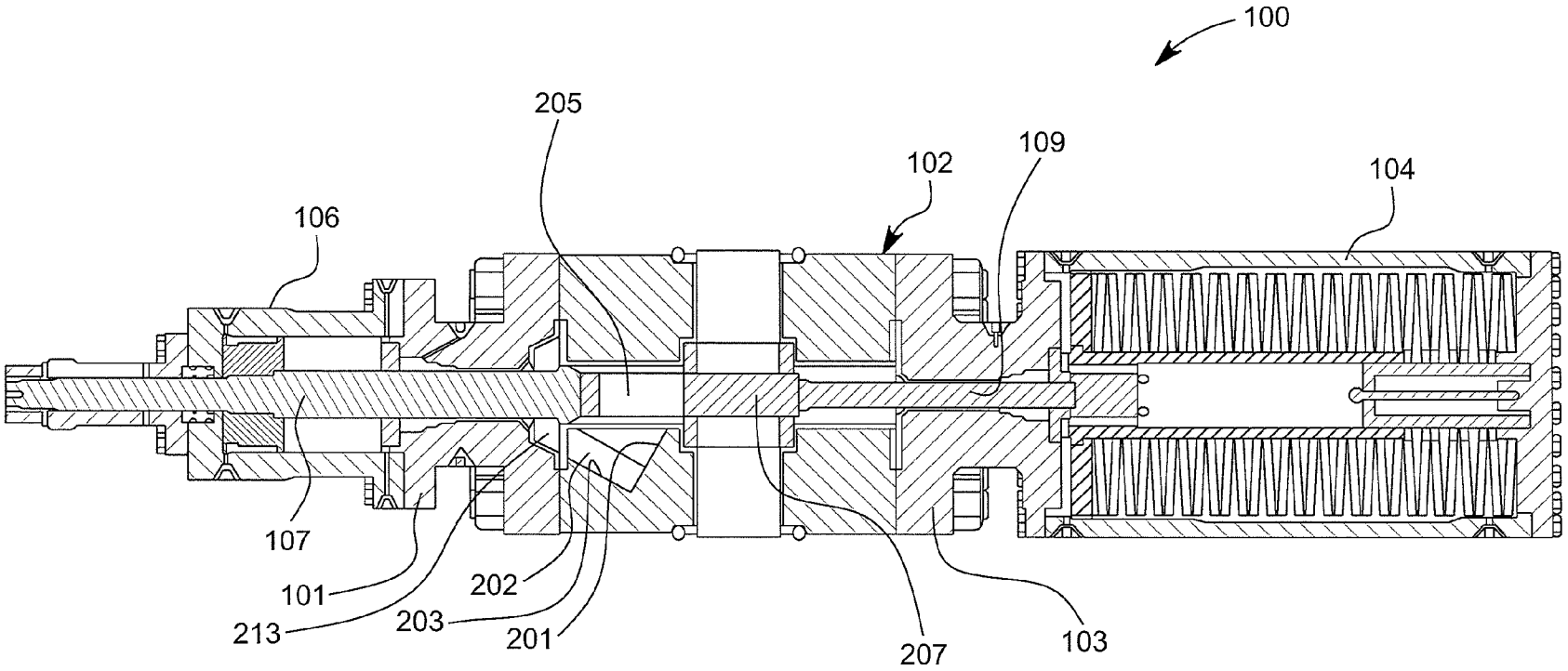
FIG. 3 illustrates a sectioned side view of the gate valve assembly according to the preferred embodiment.

FIG. 2 illustrates a sectional view of the gate valve assembly 100 in an embodiment of the invention. FIG. 3 illustrates a sectional front view of the gate valve assembly 100 in an embodiment. The valve block 102 includes a linearly and selectively moveable cutting gate 204 that is a generally a planar member. The cutting gate 204 includes a through hole 205 formed in a solid portion 207 (shown in FIG. 3) of the cutting gate 204. As shown, the valve block 102 houses a valve cavity 206 therein and a passage 208 is formed through the valve block 102 that intersects the valve cavity 206. The through hole 205 when aligned with the inlet port 108*a* and the outlet port 108*b* forms the passage 208 for the tubing conveyed strings (not shown). The actuating mechanism (104 and 106) engages the cutting gate 204 in a linear reciprocating motion. The reciprocating motion causes the cutting gate 204 to move from an "open" position to a "closed" position and vice versa.

An "open" position of the cutting gate 204 corresponds to an orientation in which the through hole 205 of the cutting gate 204 is aligned with the inlet port 108*a* and the outlet port 108*b* to allow an unobstructed flow path. On the other hand, a "closed" position of the cutting gate valve 204 corresponds to an orientation in which the through hole 205 has moved in a horizontal direction (e.g. towards left, as shown in FIGS. 2 and 3) such that the passage 208 between the inlet port 108*a* and outlet port 108*b* is obstructed by the cutting gate 204. In the embodiment of the gate valve assembly 100 shown in FIG. 2, the through hole 205 is not aligned with the passage 208 (the inlet 108*a* and the outlet port 108*b*), thereby placing the gate valve assembly 100 in the "closed" position, obstructing flow through the passage 208.

The valve block 102 further includes two annular valve seats 210 and 212 mounted co-axially to register with the passage 208, each having an end extending into the valve cavity 206. While in the "open" position the valve seats 210 and 212 sealingly contact the cutting gate 204 along an annular surface, around the through hole 205. In the closed position the valve seats 210, 212 will sealingly contact an annular surface around the homogenous part of the solid body 207, which provides a pressure seal between the valve cavity 206 and passage 208. The cutting gate 204 is selectively movable within the valve cavity 206 by one or more actuator pistons (not marked) disposed on the end of connecting rod 107 attached to opposing ends of the cutting gate 204. The actuating mechanisms 104 and 106 provide a resulting force to selectively move the cutting gate valve 204 within the gate valve assembly 100. The cutting gate 204 can be moved to put the gate valve assembly 100 into an "open" position illustrated in FIG. 4, or in a "closed" position as shown in FIG. 2 and FIG. 3. The gate valve assembly 100 is installed in such a manner that the cutting gate 204 is configured to engage in the reciprocating motion in a direction transverse to the passage 208 through which the tubing conveyed strings pass.

Figure 4:
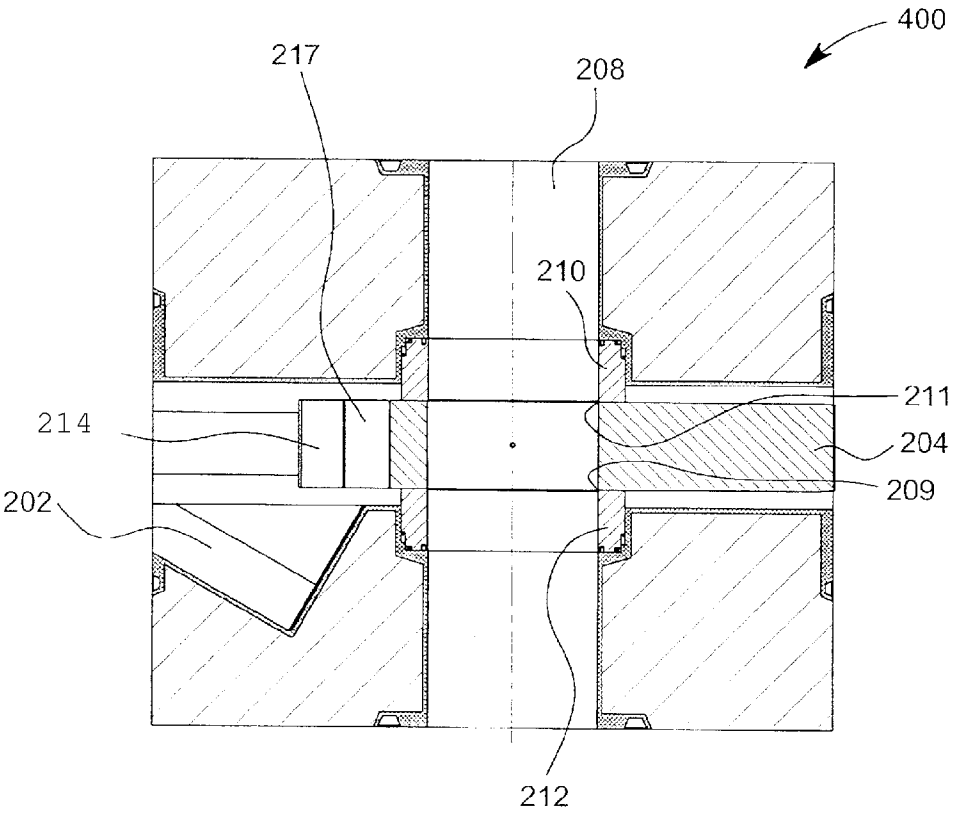
FIG. 4 illustrates the seat seals in valve block in a non-activated mode in accordance with an example embodiment.

In an implementation 400, the cutting gate 204 corresponds to a "double shear" gate valve having two shearing surfaces along its two circumferential edges. With reference to FIG. 4, two cutting edges 209 and 211 are illustrated as extending along a portion of the through hole 205. The reciprocating motion of the cutting gate 204, therefore, results in a cutting operation (by impinging) of tubing conveyed strings passing through the passage 208. The cutting operation generates a tubing conveyed string cutting (or a slug piece).

In an exemplary embodiment, the valve block 102 includes a slug pit 202 formed alongside the valve cavity 206 defining an opening to contain one or more cuttings of the tubing conveyed strings resulting from the cutting operation. The reciprocating motion of the cutting gate 204 transport one or more cuttings of the tubing conveyed strings to the slug pit 202. In an embodiment, the slug pit 202 can correspond to one of: a hollow cavity, a recess, and an enclosure formed in the valve block 102 alongside the gate cavity 206. In an exemplary embodiment, the slug pit 202 corresponds to a V-shaped cavity formed by two inclined surfaces as shown in FIG. 2. Any other shape may be possible as long as the enclosure will be positioned to receive the cuttings.

As most clearly shown in FIG. 3, the slug pit 202 has its main portion positioned within the homogenous body of the valve block 102. The space is formed by two inclined walls 201, 203 having a sharp angle of about 90 degrees at their meeting point that form a V-shaped space underneath the path of the shaft 107/gate valve 204. The wall 201 positioned closest to the centre of the valve block 102 is inclined slightly more vertically than the other wall 203, i.e. the inclination of the most central wall 201 is less than 45 degrees in relation to a vertical center line. Thanks to this arrangement, a longer portion of the other wall 203 resides within the valve block 102 then if a less sharp angle would have been used. Moreover, it facilitates easy arrangement of the neighboring void/recess 213 in the adjacent guiding body 101 that guides the moveable shaft 107. As can be noted, the slug pit 202 in a preferred embodiment is included in a space 202, 213 that also contains the recess 213 of the first guiding body 101, thereby jointly forming a kind of channel beneath the space occupied by the shaft 107. Thanks to this arrangement, the cut out material that has been collected in slug pit 202 may relatively easily be removed. Furthermore, the void also provides for easy connection and disconnection of shaft 107 with the gate valve 204, by means of providing sufficient space to interconnect the key end of the shaft 107 with the keyhole 217 of the gate valve 204.

In operation, during an emergency situation that necessitates the shutting down of an oil well or closing the well, the actuating mechanism (e.g. 104 and 106) is activated either manually or automatically. The actuating mechanisms, by means of pistons and connecting rod 107, that at its end is connected to the gate valve 204 by means of a key lock coupling arrangement 217, moves the cutting gate 204 from an "open" position to the "closed" position. During the linear movement (e.g. from right to left) of the cutting gate 204, the circumferential cutting edges (209 and 211) of the cutting gate 204 shear the tubing conveyed strings passing through the passage 208. The shearing results in a tubing conveyed string cutting or a slug piece. Immediately after the shearing, the tubing conveyed cutting remains in the thorough hole 205 of the cutting gate 204. As the cutting gate 204 moves further towards the "closed" position, the tubing conveyed strings cutting in the through hole 205 of the cutting gate 204 is transported towards the slug pit 202 formed along the gate cavity 206. The tubing conveyed string cutting falls into the slug pit 202 due to gravity. The valve seats 210 and 212 sealingly isolate the passage 208 and the valve cavity 206. At this stage, the cutting gate 204 is closed and the oil well is shut down or sealed (FIG. 2 and FIG. 3).

When the cutting gate 204 moves back to the "open" position from the "closed" position, the tubing conveyed string cuttings does not jam or obstruct the movement of the cutting gate 204. In addition, the possibility for the tubing conveyed strings cuttings being transported back into the passage 208 (or the well) is eliminated.

Figure 5B:
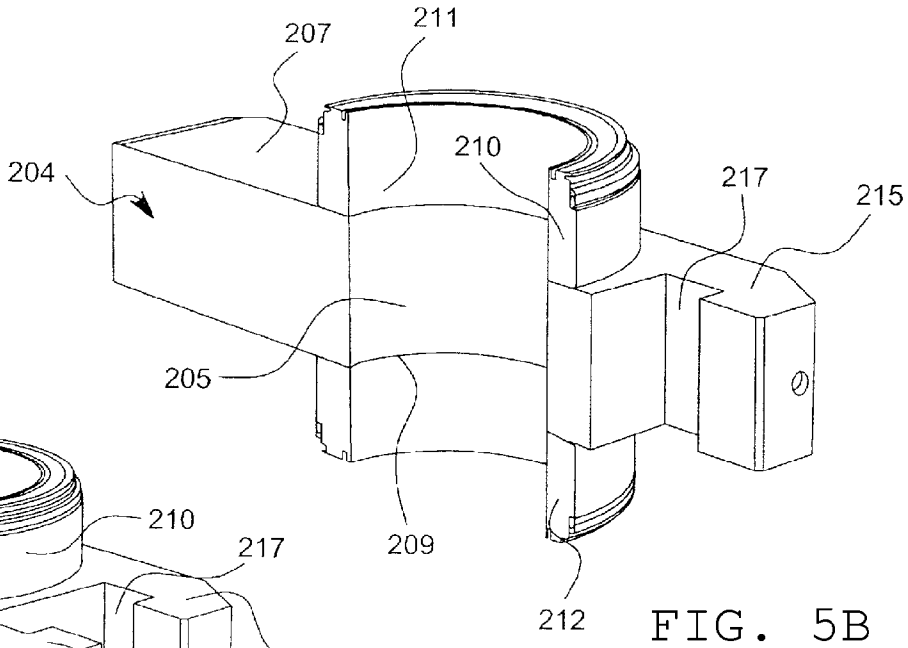
FIGS. 5A and 5B illustrate a perspective isometric view and sectional isometric view of gate valve components according to the preferred embodiment.
Figure 5A:
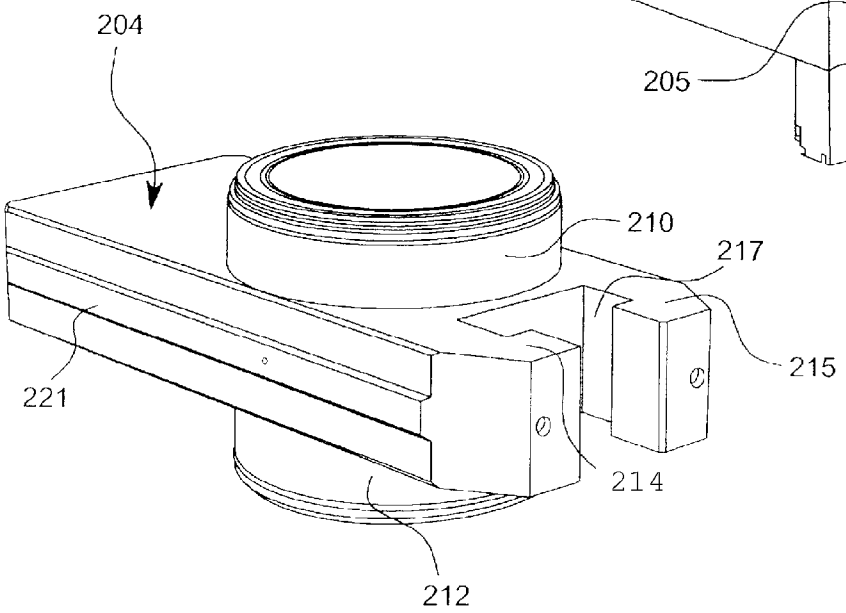

FIGS. 5A and 5B illustrate a 3-dimensional isometric view and a sectioned isometric view of the cutting gate 204 according to an embodiment. The cutting gate 204 may correspond to a component separable from the gate valve assembly 100 to facilitate easy servicing and repair. As such, different designs and dimensions can be chosen to suit the requirement in the subsea workover system.

As shown, the cutting gate 204 includes the solid portion 207 that has the through hole 205 around which the annular valve seats 210 and 212 are sealingly disposed. The solid portion 207 forms two symmetric protrusions 214 and 215 that define a key hole opening 217 in the cutting gate 204. The key hole opening 217 may be defined by two parallel surfaces in such a manner that an end of the connecting rod 107 fits into the opening 217 to result in a firm mechanical fit. The mechanical fit thus formed enables the application of a linear force to move the cutting gate 204. The actuating mechanism (hydraulic actuator 106 and spring actuator 104) exerts the force to impinge the tubing conveyed strings between the cutting edges (e.g. 211 and 209) and the passage 208. The solid portion 207 further includes a projected portion 221 that extends outwardly and longitudinally along the length of the cutting gate 204 on parallel and opposite sides. The projected portion 221 is used to position the cutting gate to be reciprocally moveable in a desired plane and as a wearing surface.

Although the gate valve assembly 100 has been described with specific references to one or more figures, it may be appreciated by those skilled in the art that various modifications can be made to one or more components of the gate valve assembly 100 without departing from the scope of the disclosed invention. Examples include, different types of actuator mechanisms such as threaded rods, piston and a connecting rod, etc. that affords an efficient deployment in a subsea workover system. In addition, additional details about other components, fit well known in the art, such as, but not restricted to well mounts and coupling mechanisms, well head systems, etc. have not been included in this description.

The disclosed embodiments of the gate valve assembly 100 and the cutting gate 204 solves the problem faced in subsea workover systems that deploy double shear gate valves for cutting tubing conveyed strings. The slug piece or the cuttings of the tubing conveyed falls into the slug pit 202 due to the reciprocating motion of the cutting gate 204. In an embodiment, the slug pit 202 can be customized to define one or more patterns and cavity shapes that would enable easy collection of the falling tubing conveyed strings cuttings. In yet another embodiment, the valve seats 210 and 212 may be disposed using spring based mechanisms. In such an embodiment, one or more springs may rest in a recess formed in the valve block 102 such that the valve seats 210 and 212 are pushed towards the cutting gate 204 due to restoration force of the springs. Other sealing mechanisms may also be used without departing from the scope of this description. It may also be noted that the cutting gate 204 has both shearing and sealing capabilities.

It is to be understood by those skilled in the art that all parts that are exposed to wear and tear will be made of hard ductile material or fitted with layers of similar hard materials known in the art.

It is also to be appreciated that the subject matter of the claims are not limited to the various examples or language used to recite the principle of the invention, and variants can be contemplated for implementing the claims without deviating from the scope. Rather, the embodiments of the invention encompass both structural and functional equivalents thereof.

While certain present preferred embodiments of the invention and certain present preferred methods of practicing the same have been illustrated and described herein, it is to be distinctly understood that the invention is not limited thereto but may be otherwise variously embodied and practiced within the scope of the following claims.

The invention claimed is:

1. A gate valve assembly for use in a subsea workover system, the gate valve assembly comprising:

a valve block defining a valve cavity and passage;

a cutting gate disposed in the valve cavity, the cutting gate having a through hole, the cutting gate configured to engage in a reciprocating motion in the valve cavity between an "open" position in which the through hole is aligned with the passage and a "closed" position in which the through hole is not aligned with passage, the cutting gate comprising two cutting edges extending along a portion of the through hole, the reciprocating motion of the cutting gate resulting in a double cutting operation of tubing conveyed strings passing through the gate valve assembly to produce a cutting of the tubing conveyed strings during each double cut of the tubing conveyed strings;

two actuating means mounted to the valve block, engaging the cutting gate in the reciprocating motion and configured to work together in the cutting operation; and a slug pit formed in the valve block alongside the valve cavity defining a space arranged to collect one or more of the cuttings of the tubing conveyed strings resulting from the cutting operation, the slug pit being separate from the valve cavity and cutting gate, wherein the assembly is constructed such that the reciprocating motion of the cutting gate transports one or more cuttings of the tubing conveyed string to the slug pit and prevents the one or more cuttings from remaining in the through hole or falling into the valve cavity or passage to avoid jamming or obstructing the cutting gate during use.

2. The gate valve assembly according to claim 1, wherein said actuating means comprises a hydraulic actuator and a spring actuator.

3. The gate valve assembly according to claim 2 wherein said space enclosing the slug pit at least mainly is formed in the valve block, which forms an integral unit.

4. The gate valve assembly according to claim 2, wherein the slug pit corresponds to a V-shaped cavity formed by two inclined surfaces.

5. The gate valve assembly according to claim 3, wherein the slug pit corresponds to a V-shaped cavity formed by two inclined surfaces.

6. The gate valve assembly according to claim 1, wherein the slug pit corresponds to one of: a hollow cavity, a recess, and an enclosure formed in the valve block alongside the gate cavity.

7. The gate valve assembly according to claim 6, wherein said space also partly is delimited by a recess in a first body arranged next to the valve block.

8. The gate valve assembly according to claim 6, wherein the slug pit corresponds to a V-shaped cavity formed by two inclined surfaces.

9. The gate valve assembly according to claim 8, wherein the V-shaped cavity has an angle in the range 70-110°.

10. The gate valve assembly according to claim 1, wherein the cutting gate comprises two cutting edges at two circumferential edges of a through hole in the cutting gate.

11. The gate valve assembly according to claim 1, wherein the tubing conveyed strings correspond to one of a wire, a cable, a coiled tubing, a pipe, a slick line, and an elongated member extending through the cutting gate.

12. The gate valve assembly according to claim 1, wherein the cutting gate corresponds to a double shear cutting gate valve.

13. The gate valve assembly according to claim 1, further comprising one or more annular valve seats positioned on either side of the cutting gate and around a through hole in the cutting gate to form a seal between the cutting gate and the valve block.

14. The gate valve assembly according to claim 1, wherein the slug pit corresponds to a V-shaped cavity formed by two inclined surfaces.

15. A method of isolating or sealing an undersea well comprising:

providing a gate valve assembly according to claim 1;

double cutting the tubing by reciprocating the cutting gate to form a cutting; and conveying the cutting to the slug pit by the reciprocating motion of the cutting gate.

* * * * *